United States Patent [19]

Arai et al.

[11] Patent Number: 4,686,118

[45] Date of Patent: Aug. 11, 1987

[54] RECORDING MEDIUM AND RECORDING METHOD BY USE THEREOF

[75] Inventors: Ryuichi Arai, Sagamihara; Mamoru Sakaki, Atsugi, both of Japan

[73] Assignee: Canon Kabushiki Kaisha, Tokyo, Japan

[21] Appl. No.: 824,574

[22] Filed: Jan. 23, 1986

[30] Foreign Application Priority Data

Jan. 28, 1985 [JP] Japan ..... 60-012603

[51] Int. Cl.[4] ..... B41M 5/00

[52] U.S. Cl. ..... 427/261; 346/1.1; 346/135.1; 428/195; 428/334; 428/335; 428/336; 428/423.1; 428/474.4; 428/478.2; 428/480; 428/500; 428/522; 428/532; 428/913

[58] Field of Search ..... 428/195, 207, 211, 411.1, 428/332, 334–336, 423.1, 474.4, 478.2, 480, 500, 522, 532, 913; 346/1.1, 135.1; 427/261, 256

[56] References Cited

U.S. PATENT DOCUMENTS

| | | | |
|---|---|---|---|
| 4,446,174 | 5/1984 | Maekawa et al. | 427/261 |
| 4,460,637 | 7/1984 | Miyamoto et al. | 428/207 |
| 4,503,111 | 3/1985 | Jaeger et al. | 428/195 |

FOREIGN PATENT DOCUMENTS

| | | | |
|---|---|---|---|
| 0051583 | 4/1980 | Japan | 428/195 |
| 0146786 | 11/1980 | Japan | 428/195 |

*Primary Examiner*—Bruce H. Hess

*Attorney, Agent, or Firm*—Fitzpatrick, Cella, Harper & Scinto

[57] ABSTRACT

A recording medium is provided which comprises having an ink receiving layer provided on a substrate, the ink receiving layer comprising at least a mixture of a polymer capable of forming intermolecular hydrogen bond and a polymer incapable of forming intermolecular hydrogen bond. The recording medium may also be further provided with an ink permeable layer.

16 Claims, No Drawings

RECORDING MEDIUM AND RECORDING METHOD BY USE THEREOF

BACKGROUND OF THE INVENTION

1. Field of the Invention

This invention relates to a recording medium to be used preferably for ink jet recording method, particularly to a recording medium excellent in ink receptivity and also excellent in sharpness of the recorded image, and also to a recording method by use thereof.

2. Description of the Related Art

Ink jet recording method performs recording by generating small droplets of ink according to various ink (recording liquid) discharging systems, such as electrostatic attraction system, a system of giving mechanical vibration or displacement to ink by means of a piezoelectric element, a system utilizing a pressure of bubbling caused by heating, permitting the droplets of ink to fly and to attach a part or whole thereof onto a recording medium such as paper. This method is now attracting attention as a recording method which generates less noise and enables high speed printing and multi-color printing.

As the ink for ink jet recording, there have been used those composed mainly of water primarily for the reasons of safety and recording characteristics, and in most cases, a polyhydric alcohol is added for prevention of clogging of nozzles and improvement of discharging stability.

As the recording medium to be used for the ink jet recording method, there have been employed recording media comprising a porous ink receiving layer provided on a conventional paper or a substrate called as the ink jet recording paper.

However, as the ink jet recording is improved in performance such as speed-up or multi-color recording and widely spread, higher and broader characteristics are becoming demanded also for the recording medium.

More specifically, the recording medium for ink jet recording for obtaining recorded images of high resolution and high quality is required to satisfy various basic requirements as follows:

(1) reception of ink onto the recording medium should be as rapid as possible;

(2) even when ink dots may be overlapped with each other, the ink attached later should not flow out into the dot attached earier;

(3) ink droplets should not diffuse on the recording medium to result in larger ink dot diameter than is necessary;

(4) the shape of an ink dot should be approximate to a true circle and its circumference should be smooth;

(5) OD (optical density) of ink dot should be high, without obscurity around the dot; etc.

Further, for obtaining a recorded image quality of high resolution comparable to color photography by the multi-color ink jet recording method, the following performances are additively required in addition to the above requisite performances:

(6) the coloring component of ink should be excellent in color forming property;

(7) since liquid droplets which are the same in number as the number of ink colors may be sometimes attached on the same spot to overlap each other, ink fixing characteristic should be excellent;

(8) the surface should have gloss; and (9) the degree of whiteness should be high.

Further, while the recorded images obtained by the ink jet recording method have been employed in the past exclusively for surface image observation, recording media suitable for uses other than for surface image observation are becoming demanded with improvement in performances or propagation of the ink jet recording device.

Uses of the recording medium other than for surface image observation may include those in which recorded images are projected onto a screen, etc. by means of an optical instrument such as a slide or an OHP (an overhead projector), etc. and those images are observed, color resolution plates during preparation of a positive plate for color printing, and a CMF (color mosaic filter), etc. to be used for color display such as liquid crystal, etc.

When the recording medium is to be used for surface image observation, the diffused light of the recorded image is observed, while the transmitted light through the recorded images is observed in the recording medium in these uses. Accordingly, light transmissivity, particularly excellent linear transmittance is required in addition to the requisite performances in general of the recording medium for ink jet recording.

However, no recording medium satisfying all of these requisite performances has yet been known.

Most of the recording media for surface image observation of the prior art have employed a system in which a porous ink receiving layer is provided on the surface and the recording agent is fixed by permitting the ink to be received into the porous voids, and hence the surface of the recording medium was lacking in gloss due to the porous structure.

On the other hand, in the case of the surface of an ink receiving layer which is non-porous, a non-volatile component such as polyhydric alcohol, etc. in the ink after practicing recording will remain on the surface of the recording medium for a long time, whereby drying and fixing time of ink is prolonged, thus involving the drawbacks such that clothings may be contaminated by contact with the recorded images or that the recorded images may be damaged.

SUMMARY OF THE INVENTION

An object of the present invention is to provide a recording medium for use in ink jet recording which is particularly excellent in ink receiving characteristic and sharpness of recorded image.

Another object of the present invention is to provide a recording medium for use in full color ink jet recording which is excellent in ink receiving characteristic, sharpness of recorded image and surface gloss.

Still another object of the present invention is to provide a recording medium for use in ink jet recording, which can be used for observation by projection of recorded image by means of an optical instrument such as a slide or an OHP, or which can be used for observation of transmitted light such as a color resolution plate during preparation of a positive plate for color printing or a CMF, etc. to be used for color display such as liquid crystal.

The above objects and other objects of the present invention can be accomplished by the present invention as described below.

According to the present invention, there is provided a recording medium which comprises having an ink receiving layer comprising at least a mixture of a polymer capable of forming intermolecular hydrogen bond and a polymer incapable of forming intermolecular hydrogen bond.

The present invention also provides a recording medium, which comprises having an ink receiving layer provided on a substrate, said ink receiving layer comprising at least a mixture of a polymer capable of forming intermolecular hydrogen bond and a polymer incapable of forming intermolecular hydrogen bond.

Further, the present invention provides a recording medium, which comprises having an ink permeable layer and an ink receiving layer provided on a substrate, said ink receiving layer comprising at least a mixture of a polymer having capability of forming intermolecular hydrogen bond and a polymer incapable of forming intermolecular hydrogen bond.

In another aspect of the invention, there is provided a recording method which performs recording by forming liquid droplets of a recording liquid and attaching said liquid droplets onto a recording medium, wherein said recording liquid is an aqueous ink and said recording medium has an ink receiving layer comprising at least a mixture of a polymer capable of forming intermolecular hydrogen bond and a polymer incapable of forming intermolecular hydrogen bond.

DETAILED DESCRIPTION OF THE PREFERRED EMBODIMENTS

To describe the present invention in detail, the recording medium of the present invention is characterized principally in that its recording surface contains a mixture of Polymer A and Polymer B, and the objects of the present invention can be accomplished primarily by such a characteristic.

The recording medium of the present invention generally comprises a substrate as the supporting material and a recording surface, namely an ink receiving layer, provided on the substrate. For example, particularly preferred embodiments may include the following:

(1) the embodiment in which both of the substrate and the ink receiving layer are light transmissive, and the recording medium as a whole is light transmissive; and (2) the embodiment in which the surface of the ink receiving layer is smooth and has gloss.

Also, in each embodiment, the ink receiving layer may also have the function of a support at the same time.

To describe in more detail the present invention by referring to some preferred embodiments as mentioned above as typical examples, Polymer A and Polymer B which characterize principally the present invention may be selected and used from among, for example, water-soluble to hydrophilic natural resins such as albumin, gelatin, casein, starch, cationic starch, gum arabic, sodium alginate, etc.; water-soluble to hydrophilic synthetic resins such as polyethylene glycol, polyamide, polyacrylamide, polyvinyl pyrrolidone, quaternarized polyvinyl pyrrolidone, polyethyleneimine, polyvinylpyridinium halide, melamine resin, polyurethane, carboxymethyl cellulose, hydroxymethyl cellulose, polyvinyl alcohol, cation-modified polyvinyl alcohol, polyester, sodium polyacrylate, etc.; and hydrophobic resins such as SBR latex, NBR latex, polyvinyl formal, polymethyl methacrylate, polyvinyl butyral, polyacrylonitrile, polyvinyl chloride, polyvinyl acetate, phenol resin, alkyd resin, etc.

The present inventors have already found that these polymers may be available for formation of an ink receiving layer, either singly or as a mixture. However, in the prior art, the ink receiving layer formed of these polymers, although excellent in ink receiving characteristic under highly humid conditions, posed various problems such as lowering in strength of the ink receiving layer and becoming sticky on the surface, or taking a long time in receiving ink under low humidity conditions.

The present inventors have studied intensively in order to overcome such drawbacks of the prior art and consequently found that use of a mixture of polymers with different properties relative to moisture, namely formation of an ink receiving layer by mixing Polymer A and Polymer B, will not result in lowering in strength of the ink receiving layer even under high temperature and high humidity conditions without causing stickiness of the surface, and further can form an ink receiving layer exhibiting excellent ink receiving characteristic even under low temperature and low humidity conditions, thus revealing only the advantages of Polymer A and Polymer B without manifestation of the drawbacks of both polymers.

Polymer A and Polymer B to be used in the present invention may be selected and used from various polymers as mentioned above according to their properties. When using both polymers in combination, it is desirable that at least one of them should be a hydrophilic or water-soluble polymer.

Preferred as Polymer A is a polymer having a number of hydroxyl groups, carboxyl groups, imino groups in side chains, such as starch, casein, sodium alginate, polyvinyl alcohol, polyamide, polyacrylamide, polyethyleneimine, polyurethane, carboxymethyl cellulose, hydroxymethyl cellulose or derivatives of these.

On the other hand, preferred as Polymer B is a polymer not having a number of hydroxyl groups, etc. in the side chains, such as polyethylene glycol, polyester, polymethyl methacrylate, polyvinyl pyrrolidone, polyvinyl acetate, polyacrylonitrile or derivatives of these.

Polymer A and Polymer B as described above may be used at any desired proportion, but it is preferred to use about 25 to 400 parts by weight of Polymer B per 100 parts by weight of Polymer A.

In the present invention, as described above, Polymer A reinforces the coating formed, prevents the recording surface from becoming sticky even under highly humid condition, forms a strong wet coating also at the portion recorded by ink, and also retains excellent ink receiving characteristic even under low temperature and low humidity conditions due to the presence of Polymer B mixed therein. Thus, as compared with the case when either one of the polymers is employed, it may be considered that more rapid ink receiving characteristic can be exhibited under all conditions. Such an effect by mixing Polymer A with Polymer B is a synergetic effect which cannot be expected from use of either one of them alone.

The substrate to be used as the supporting material for the ink receiving layer in the present invention may be any substrate known in the art, transparent or opaque. Preferable examples of transparent substrates may include films or plates such as of polyester resins, diacetate resins, polycarbonate resins, polyvinyl chloride resins, polyimide resins, Cellophane, Celluloid, etc. and glass plates. Preferable opaque substrates may include, for example, paper, cloth, wood, metal plate, synthetic paper in general, or otherwise the above transparent substrates which have been subjected to opacifying treatment according to known means.

The recording medium of the present invention is formed by use of the main materials as described above. In the preferable embodiment (1) as mentioned above, both of the substrate and the ink receiving layer are light transmissive, with the linear transmittance being 10% or higher, and it is an embodiment in which the recording medium as a whole is light transmissive. The recording medium of this embodiment is particularly excellent in light transmissivity and used primarily in the case of OHP, etc. in which recorded image is projected onto a screen, etc. by means of an optical instrument, thus being useful for observation of transmitted light.

Such a light transmissive recording medium can be prepared by forming a light transmissive ink receiving layer from a mixture of Polymer A and Polymer B as described above alone or together with another light transmissive polymer on the light transmissive substrate as described above.

As the method for forming such an ink receiving layer, there may preferably be employed a method in which a coating solution is prepared by dissolving or dispersing the above mixture of Polymer A and Polymer B alone or together with another appropriate polymer and said solution is coated on the light transmissive substrate according to the known method such as roll coating, rod bar coating, spray coating, air knife coating, etc., followed by rapid drying. It is also possible to use the method in which the above mixture of Polymer A and Polymer B alone or a mixture together with another polymer is subjected to hot melt coating or the method in which a single sheet for ink receiving layer is once formed from the material as described above, and said sheet is laminated on the above substrate.

Also, for improvement of ink receiving characteristic of the ink receiving layer in the method as described above, it is possible to disperse fillers such as silica, clay, talc, diatomaceous earth, calcium carbonate, calcium sulfate, barium sulfate, aluminum silicate, synthetic zeolite, alumina, zinc oxide, lithopon, satin white, etc. to such an extent that light transmissivity of the recording medium is not impaired.

The recording medium according to the embodiment (1) formed as described above is a light transmissive recording medium having sufficient light transmissivity.

The sufficient light transmissivity as herein mentioned means the linear transmittance of the recording medium of at least 10%.

If the linear transmittance is 2% or higher, the recorded image can be observed by projection by, for example, OHP onto a screen. Further, in order for the fine portion of the recorded image to be observed sharply, the linear transmittance should desirably be 10% or higher.

The linear transmittance T (%) as herein mentioned is a value which is determined by measuring the spectral transmittance of the linear light which enters a sample perpendicularly, transmits through the sample, passes through a slit on the light receiving side which is located at least 8 cm apart from the sample on the line extended from the incident light pathway and is received on a detector, by means of, for example, 323 Model Hitachi Automatic Recording Spectrophotometer (produced by Hitachi, Ltd.), further determining the Y value of tristimulus values of color and calculating from the following formula:

$$T = Y/Yo \times 100 \quad (1)$$

T: linear transmittance
Y: Y value of sample
Yo: Y value of control

Thus, the linear transmittance as mentioned in the present invention is relative to linear light, and it is different from diffuse transmittance (transmittance is determined so as to be inclusive of diffused light by providing an integrating sphere at the rear of a sample) or opacity (determined from the ratio of values when white and black backings are placed on the back of a sample) according to the method in which light transmissivity is evaluated with diffused light.

Since a problem in an instrument utilizing optical techniques is the behavior of linear light, determination of the linear transmittance of a recording medium is particularly important in evaluation of the light transmissivity of the recording medium to be used in such an instrument.

For example, in the case of observing a projected image by OHP, in order to obtain an image which is high in contrast between the recorded portion and the non-recorded portion, sharp and easy to see, it is demanded that the non-recorded portion in the projected image should be light, namely that the linear transmittance of the recording medium should be at a certain level or higher. In the test by means of a test chart in OHP, for obtaining an image suited for the above purpose, the linear transmittance of the recording medium is required to be 2% or higher, preferably 10% or higher in order to obtain a sharper image. Therefore, the recording medium suited for this purpose is required to have a linear transmittance which is at least 2%.

The embodiment (2) as mentioned above is also a kind of the above embodiment (1), and it is characterized in that the surface of its ink receiving layer is smooth and has a 45 degree specular gloss of at least 30% based on JIS Z8741. The recording medium of said type is particularly excellent in specular gloss and particularly useful as a recording medium for observation of a surface image which is of full color and excellent in sharpness. The recording medium according to this embodiment may be either transparent or opaque, and any of the above transparent and opaque materials can be used. The ink receiving layer may also be either transparent or opaque. The materials and the method to be used for formation of the ink receiving layer may be the same as described above, but the above-mentioned fillers can be used even to such an extent that the ink receiving layer may become opaque, provided that the surface of the ink receiving layer can retain smoothness.

Further, if desired, in addition to the coating methods as described above, it is also possible to use the coating method or to effect glossing by means of calender rolls.

In the present invention as described above, the ink receiving layer to be formed on the substrate may have an approximate thickness of generally 1 to 200 μm, preferably 3 to 100 μm, or more preferably 5 to 30 μm.

While the recording medium of the present invention may be obtained as described above, according to the detailed study by the present inventors, it has been found that a further excellent recording medium can be obtained by forming on the surface of the ink receiving layer as formed above an ink permeable layer having the functions of permitting ink to pass freely therethrough and being capable of protecting the surface in order to further prevent the surface of said ink receiving layer from becoming sticky under highly humid condition.

Such an ink permeable layer is a thin layer made of a natural or synthetic resin provided on the ink receiving layer formed as described above, having the functions of expanding rapidly (for example, within several seconds) the contact area to the extent so that adjacent small droplets may not overlap each other on adhesion of small droplets of ink on its surface, and also promoting permeation of the ink into the ink receiving layer and reception of the ink by the ink receiving layer.

The present inventors have studied intensively about imparting the functions as described above to the ink receiving layer and found, entirely unexpectedly, that the above functions can readily be achieved by forming a thin layer comprising a polymer which is equal or inferior in hydrophilicity to the polymer constituting the ink receiving layer on the above ink receiving layer. It is indeed surprising that such functions could be achieved with a thin film of a polymer which is completely or substantially insoluble in water.

The ink permeable layer having the functions as described above has been accomplished by forming a thin film of about 10 μm or less, preferably about 0.01 to 3 μm, of a polymer which is equal or relatively inferior in hydrophilicity to the polymer material forming the ink receiving layer.

The polymer material useful for formation of such a thin film may preferably be selected from homopolymers or copolymers formed from vinyl acetate, acrylic acid ester, ethylene, vinyl chloride or other vinyl monomers, and polymers formed from vinyl monomers as mentioned above and various hydrophilic vinyl monomers, and further polymers such as vinylon, polyurethane, cellulose derivatives, polyester, polyamide, etc., and also from the hydrophilic polymers for formation of the ink receiving layer as mentioned above, either alone or as a mixture, so that the polymer selected may be inferior in hydrophilicity than that used in the ink receiving layer.

The polymer to be selected may be in the form of a solution in an organic solvent, but it is preferable to use it in the form of an emulsion in an aqueous medium or a micro-dispersion in an organic solvent or an aqueous medium. When it is to be used in the form of an organic solvent solution, it should be used as a relatively dilute solution or at a concentration so that the layer to be formed may be within the range as mentioned above.

As the method for formation of an ink permeable layer by use of the materials as mentioned above, the same method as in formation of the above ink receiving layer can be employed.

It is surprising enough that the recording medium of the present invention provided with an ink permeation layer as described above, in spite of the hydrophilicity of the ink permeation layer which is equal or inferior to that of the ink receiving layer, is improved markedly in ink receptivity and ink fixability as compared with the recording medium of the prior art having no such ink permeable layer. At present, it is thought that the ink permeable layer is not necessarily a continuous coating, but contains virtually infinite fine gaps in the ink permeable layer through which an aqueous ink can permeate into the ink receiving layer. Additionally, it is thought that the ink permeable layer surface is irregular in micron units, with the result that the small ink droplets can rapidly be diffused on its surface to enlarge thereby the contact areas thereof, whereby both the ink absorbability by the ink receiving layer and the fixing characteristic can markedly be promoted. Since the ink permeable layer of the recording medium of the present invention can be formed of a polymer lower in hydrophilicity than the ink receiving layer, the ink once received will not be oozed out on the surface even in an atmosphere of high temperature and high humidity, thus not contaminating the instrument, the operator or surroundings. The surface will not become sticky under high temperature and high humidity conditions.

Further, in the present invention, by imparting organic or inorganic fine powder at a proportion of about 0.01 to about 1.0 g/m$^2$ to the recording surface of the recording medium of various embodiments as described above, the conveying characteristic within the printer, antiblocking characteristic during piling, fingerprint resistance, etc. of the recording medium obtained can be further improved.

Having described above by referring to examples of typical embodiments of the recording medium of the present invention, the recording medium of the present invention will not of course be limited to these embodiments. In either of these embodiments, the ink receiving layer and/or the ink permeable layer can incorporate various known additives, including dispersing agents, fluorescent dyes, pH controllers, antifoaming agents, lubricants, preservatives, surfactants, etc.

The recording medium of the present invention is not necessarily required to be colorless, but it may also be a colored recording medium.

According to the recording medium of the present invention containing a mixture of Polymer A and Polymer B as described above, excellent ink receptivity is exhibited at any temperature and any humidity. Thus, even when inks with different colors may be attached on the same spot to overlap each other within a short time, there is no such phenomenon as flowing-out or oozing-out, whereby there can be obtained an image which is sharp with high resolution, excellent in color forming property and resistant to water. Besides, it is also possible to provide a recording medium excellent in surface gloss which has not been found in the recording medium for ink jet recording of the prior art. Further, it can be applied for uses other than surface image observation of the prior art such as for observation by projection of a recorded image by an optical instrument such as slide, OHP, etc., color resolution plate during preparation of a positive plate for color printing, or a CMF, etc. to be used for color display such as liquid crystal, etc.

The present invention is described in more detail by referring to the following Examples, in which parts are based on weight.

EXAMPLE 1

As a light transmissive substrate, a polyethyleneterephthalate film with a thickness of 100 μm (produced by Toray) was employed, and a coating solution having the composition shown below was coated onto this film to a film thickness of 8 μm after drying according to the bar coater method, and dried under the conditions of 80° C. and 10 minutes to give a light transmissive recording medium of the present invention.

Coating solution composition:

Polymer A: 8 Parts
Polymer B: 2 Parts
Water/dimethylformamide (1/1): 90 Parts

In the above composition, Polymer A was a polyvinyl alcohol (PVA-420H, produced by Kuraray), and Polymer B was a vinyl acetate/vinyl pyrrolidone copolymer (LUVISKOL 73E, produced by Yuka-Badische).

The recording medium of the present invention thus obtained was found to be colorless and transparent.

EXAMPLES 2-3 AND COMPARATIVE EXAMPLES 1-2

By use of the substrates and the compositions as shown below, two kinds of light transmissive recording media of the present invention (Examples 2-3) and two kinds of recording media for comparative purpose (Comparative Examples 1-2) were obtained by forming an ink absorbing layer by coating onto the substrate according to the bar coater method to a dry film thickness of 8 μm, followed by drying under the conditions of 80° C. and 10 minutes, respectively.

EXAMPLE 2

Substrate
PET 100 μm (produced by Toray)
Composition
Hydroxyethylcellulose (HEC AG-15, produced by Fujiheck): 3 Parts
Polyvinyl alcohol (PVA KL-318, produced by Kuraray): 3 Parts
Polyvinyl pyrrolidone (PVP K-90, produced by GAF): 2 Parts
Water: 92 Parts

EXAMPLE 3

Substrate
Cast coated paper (Mirrorcoat-Gold, 105 g/m$^2$, produced by Kanzaki Seishi)
Composition
Polyvinyl alcohol (PVA-220, produced by Kuraray): 5 Parts
Polyvinyl pyrrolidone (PVP K-90, produced by GAF): 2 Parts
Triethylene glycol (reagent grade): 0.3 Parts
Water: 90 Parts

COMPARATIVE EXAMPLE 1

Substrate
PET 100 μm (produced by Toray)
Composition
PVA-220 (produced by Kuraray): 10 Parts
Water: 90 Parts

COMPARATIVE EXAMPLE 2

Substrate
Cast coated paper
Composition
PVP K-90 (produced by GAF): 10 Parts
Water: 90 Parts

EXAMPLES 4-6

Onto the surfaces of the recording media obtained in Examples 1 to 3, the coating solutions B-1, B-2 and B-3 shown below were coated to dry film thicknesses of 0.1 μm, 2 μm and 0.05 μm, respectively, dried at 70° C. for 10 minutes, and further ink permeable layers were formed thereon to obtain recording media of the present invention.

Composition of Coating Solution B-1

Carboxymethylcellulose (CELOGEN BS, produced by Daiichi Kogyo Seiyaku): 2 Parts
Water: 98 Parts Composition of Coating Solution B-2

Polyacrylic acid ester (DAIKALAC S, produced by Daido Kasei Kogyo K.K.): 5 Parts
Water: 95 Parts Composition of Coating Solution B-3

Polyvinyl acetate (MOWINYL 303, produced by Hoechst): 10 Parts
Water: 90 Parts

On the recording media of the above Examples and Comparative examples, ink jet recording was practiced by use of the four kinds of ink as shown below by means of a recording device having an on-demand type ink jet recording head which discharges ink by piezoelectric vibrator (discharge orifice diameter: 60 μm, piezoelectric vibrator driving voltage: 70 V, frequency 2 KHz).

| | |
|---|---|
| Yellow ink (composition) | |
| C.I. Direct Yellow 86 | 2 Parts |
| Diethylene glycol | 20 Parts |
| Polyethylene glycol #200 | 10 Parts |
| Water | 70 Parts |
| Red ink (composition) | |
| C.I. Acid Red 35 | 2 Parts |
| Diethylene glycol | 20 Parts |
| Polyethylene glycol #200 | 10 Parts |
| Water | 70 Parts |
| Blue ink (composition) | |
| C.I. Direct Blue 86 | 2 Parts |
| Diethylene glycol | 20 Parts |
| Polyethylene glycol #200 | 10 Parts |
| Water | 70 Parts |
| Black ink (composition) | |
| C.I. Food Black 2 | 2 Parts |
| Diethylene glycol | 20 Parts |
| Polyethylene glycol #200 | 10 Parts |
| Water | 70 Parts |

The results of evaluation of the recording media of Examples and Comparative Examples are shown in Table 1.

The respective evaluation items in Table 1 were measured following the methods as described below.

(1) Ink fixing time was determined by leaving the recording medium after recording to stand under the environmental conditions of 10° C., 30% RH; 20° C., 65% RH; and 35° C., 80% RH, and measuring the time required for drying ink to such an extent that the ink does not stick to a finger when the recorded image was touched with a finger.

(2) Dot density was measured for black dot by means of Sakura Microdensitometer PDM-5 (produced by Konishiroku Photo Industry K.K.) by applying JIS K7505 for printed microdots.

(3) OHP adaptability was measured as a typical example of an optical instrument. The recorded image was projected by OHP onto a screen, and judged by visual observation. One which can provide a projected image which is light at non-recorded portion, high in OD (optical density) of recorded image, sharp and easy to see with high contrast is rated as o; one which can provide a projected image which is slightly dark at non-recorded portion, slightly low in OD of recorded image and not clearly discriminable between the lines with a pitch width of 0.5 mm and a boldness of 0.25 mm is rated as Δ; one which can provide a projected image which is considerably dark at non-recorded portion, considerably low in recorded image and not clearly discriminable between the lines with a pitch width of 1 mm and a bondness of 0.3 mm, or which is indiscriminable between non-recorded portion and recorded image, was rated as x.

(4) Linear transmittance was determined by measuring the spectral transmittance by means of 323 Model Hitach Automatic Recording Spectrophotometer (produced by Hitachi, Ltd.) while maintaining the distance from the sample to the window on the light receiving side at about 9 cm and calculating from the above formula (1).

(5) Film strength was determined by peeling test with the use of Cellophane tape on the printed portion under various conditions of ink fixing test.

TABLE 1

| | Example | | | | | | Comparative Example | |
|---|---|---|---|---|---|---|---|---|
| | 1 | 2 | 3 | 4 | 5 | 6 | 1 | 2 |
| Ink fixing time | | | | | 1 min. | 1 min. | 15 min. | 3 min. |
| 10° C. 30% RH | 1.5 min. | 1.5 min. | 1.5 min. | 1 min. | 40 sec. | 40 sec. | 3 min. | 3 min. |
| 20° C. 65% RH | 1 min. | 1 min. | 1 min. | 40 sec. | 1 min. | 1 min. | 1 min. | 40 sec. |
| 35° C. 80% RH | 1.5 min. | 1.5 min. | 1.5 min. | 1 min. | 1 min. | 1 min. | 5 min. | sticky, printing impossible |
| Dot density | 1.0 | 1.0 | 1.0 | 1.0 | 1.0 | 1.0 | 1.0 | 1.0 |
| OHP adaptability | o | o | o | o | o | o | o | o |
| Linear transmittance | 80% | 80% | 80% | 78% | 77% | 80% | 81% | 80% |
| Film strength | o | o | o | o | o | o | o | x |

What is claimed is:

1. A recording medium for ink jet recording, comprising an ink receiving layer including at least a predetermined thickness of a mixture of a first polymer capable of forming an intermolecular hydrogen bond and a second polymer incapable of forming an intermolecular hydrogen bond, at a preselected weight ratio of the first polymer to the second polymer ranging from 4:1 to 1:4, said ink receiving layer being provided on a light-transmissive substrate, wherein the thickness of the mixture and the preselected weight ratio provide the recording medium with a linear light transmittance of not less than 77%.

2. The recording medium according to claim 1, wherein said ink receiving layer has a thickness of 1 to 200 μm.

3. The recording medium according to claim 1, wherein said ink receiving layer has a thickness of 3 to 100 μm.

4. The recording medium according to claim 1, wherein said ink receiving layer has a thickness of 5 to 30 μm.

5. A recording medium for ink jet recording, comprising an ink receiving layer including at least a predetermined thickness of a mixture of a first polymer capable of forming an intermolecular hydrogen bond, which first polymer is selected from the group consisting of starch, sodium alginate, polyvinyl alcohol, polyamide, polyacrylamide, polyethyleneimine, polyurethane, carboxymethylcellulose, hydroxymethylcellulose, hydroxyethylcellulose and derivatives thereof, and a second polymer incapable of forming an intermolecular hydrogen bond, which second polymer is selected from the group consisting of polyethylene glycol, polyester, polymethyl methacrylate, polyvinyl pyrrolidone, polyvinyl acetate, polyacrylonitrile and derivatives thereof, wherein a preselected weight ratio of the first polymer to the polymer ranges from 4:1 to 1:4, said ink receiving layer is provided on a light-transmissive substrate and the thickness of the mixture and the preselected weight ratio provide the recording medium with a linear light transmittance of not less than 77%.

6. The recording medium according to claim 5, wherein said polyamide may be casein or gelatin.

7. The recording medium according to claim 5, wherein said ink receiving layer has a thinkness of 1 to 200 μm.

8. The recording medium according to claim 5, wherein said ink receiving layer has a thickness of 3 to 100 μm.

9. The recording medium according to claim 5, wherein said ink receiving layer has a thickness of 5 to 30 μm.

10. An ink jet recording method which performs recording by attaching droplets of a recording liquid containing a water-soluble dye, water, and water-soluble organic solvent onto a recording medium, said recording medium comprising an ink receiving layer including at least a predetermined thickness of a mixture of a first polymer capable of forming an intermolecular hydrogen bond and a second polymer incapable of forming an intermolecular hydrogen bond, at a preselected weight ratio of the first polymer to the second polymer ranging from 4:1 to 1:4, said ink receiving layer being provided on a light transmissive substrate, wherein the thickness of the mixture and the preselected weight ratio provide the recording medium with a linear light transmittance of not less than 77%.

11. A recording method according to claim 10, wherein the first polymer is selected from the group consisting of starch, sodium alginate, polyvinyl alcohol, polyamide, polyacrylamide, polyethyleneimine, polyurethane, carboxymethylcellulose, hydroxymethylcellulose, hydroxyethylcellulose and derivatives thereof.

12. A recording method according to claim 11, wherein said polyamide may be casein or gelatin.

13. A recording medium according to claim 10, wherein the second polymer is selected from the group consisting of polyethylene glycol, polyester, polymethyl methacrylate, polyvinyl pyrrolidone, polyvinyl acetate, polyacrylonitrile and derivatives thereof.

14. The ink jet recording method according to claim 10, wherein said ink receiving layer has a thickness of 1 to 200 μm.

15. The ink jet recording method according to claim 10, wherein said ink receiving layer has a thickness of 3 to 100 μm.

16. The ink jet recording method according to claim 10, wherein said ink receiving layer has a thickness of 5 to 30 μm.

* * * * *

UNITED STATES PATENT AND TRADEMARK OFFICE

CERTIFICATE OF CORRECTION

PATENT NO. : 4,686,118

DATED : August 11, 1987

INVENTOR(S) : RYUICHI ARAI, ET AL.

It is certified that error appears in the above-identified patent and that said Letters Patent is hereby corrected as shown below:

COLUMN 12

Line 2, "to the polymer" should read --to the second polymer--.

Line 55, "medium" should read --method--.

Signed and Sealed this

Twenty-ninth Day of December, 1987

*Attest:*

DONALD J. QUIGG

*Attesting Officer*

*Commissioner of Patents and Trademarks*